US009061866B2

(12) United States Patent
Yustus

(10) Patent No.: US 9,061,866 B2
(45) **Date of Patent: *Jun. 23, 2015**

(54) LIFTING ASSEMBLY

(71) Applicant: Konecranes Plc, Hyvinkää (FI)

(72) Inventor: Joseph A. Yustus, Hartford, WI (US)

(73) Assignee: Konecranes Plc, Hyvinkää (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/459,147

(22) Filed: Aug. 13, 2014

(65) Prior Publication Data

US 2014/0348627 A1 Nov. 27, 2014

Related U.S. Application Data

(63) Continuation of application No. 13/959,831, filed on Aug. 6, 2013, now Pat. No. 8,833,822, which is a continuation of application No. 13/440,011, filed on Apr. 5, 2012, now Pat. No. 8,523,253.

(51) Int. Cl.
*B66C 1/36* (2006.01)
*B66C 1/34* (2006.01)

(52) U.S. Cl.
CPC .... *B66C 1/36* (2013.01); *B66C 1/34* (2013.01)

(58) Field of Classification Search
CPC ..... B66C 1/34; B66C 1/36
USPC ..... 294/82.21, 82.22, 82.3, 82.31, 82.33, 294/82.34, 75, 110.1
See application file for complete search history.

(56) References Cited

U.S. PATENT DOCUMENTS

| | | | |
|---|---|---|---|
| 261,749 | A | 7/1882 | Morris |
| 312,714 | A | 2/1885 | Foster |
| 706,248 | A | 8/1902 | Merches |
| 1,101,113 | A | 6/1914 | Attfield |
| 1,368,647 | A | 2/1921 | Myers |
| 1,381,405 | A | 6/1921 | Dunham |
| 1,451,324 | A | 4/1923 | Casamayor |

(Continued)

FOREIGN PATENT DOCUMENTS

| | | |
|---|---|---|
| DE | 3333356 | 3/1984 |
| FR | 1180424 | 6/1959 |

(Continued)

OTHER PUBLICATIONS

International Search Report and Written Opinion for Application No. PCT/IB2013/001174 dated Apr. 3, 2013 (12 pages).

*Primary Examiner* — Dean Kramer
(74) *Attorney, Agent, or Firm* — Michael Best & Friedrich LLP

(57) ABSTRACT

A lifting assembly includes a link member defining a pivot axis and a latch axis. The lifting assembly also includes a latch pin and a jaw member. The jaw member is pivotally coupled to the link member about the pivot axis and selectively fixedly coupled to the link member about the latch axis by the latch pin. The jaw member defines a cam surface. Engaging the cam surface with a load rotates a portion of the jaw member into alignment with the latch axis, such that the latch pin may be received by the jaw member and the link member.

23 Claims, 4 Drawing Sheets

(56) References Cited

U.S. PATENT DOCUMENTS

| | | | | |
|---|---|---|---|---|
| 1,530,010 | A | 3/1925 | Neilson | |
| 1,559,849 | A | 11/1925 | Cameron | |
| 1,758,722 | A | 5/1930 | Symonds | |
| 2,165,413 | A | 7/1939 | Ratigan | |
| 2,395,990 | A | 3/1946 | Boree | |
| 2,476,734 | A | 7/1949 | Jellison | |
| 2,608,432 | A | 8/1952 | Coffing | |
| 2,664,175 | A | 12/1953 | Hertel et al. | |
| 2,987,341 | A * | 6/1961 | Peck et al. | 294/82.33 |
| 2,989,336 | A | 6/1961 | Henry | |
| 3,106,420 | A | 10/1963 | Elsner | |
| 3,533,655 | A | 10/1970 | Harley | |
| 3,722,943 | A | 3/1973 | Kalua, Jr. | |
| 3,911,671 | A | 10/1975 | Guillen | |
| 3,930,290 | A | 1/1976 | Mangels | |
| 4,093,293 | A | 6/1978 | Huggett | |
| 4,174,132 | A | 11/1979 | Crook, Jr. | |
| 4,379,579 | A | 4/1983 | Mahan et al. | |
| 4,632,443 | A | 12/1986 | Miller et al. | |
| 4,767,144 | A | 8/1988 | Hörnberg | |
| 5,114,200 | A | 5/1992 | Visnyouszky et al. | |
| 5,271,128 | A | 12/1993 | Storm | |
| 5,292,165 | A | 3/1994 | Wiklund | |
| 5,634,246 | A | 6/1997 | Jermyn, Jr. | |
| 8,523,253 | B1 | 9/2013 | Yustus | |
| 8,833,822 | B2 * | 9/2014 | Yustus | 294/82.34 |

FOREIGN PATENT DOCUMENTS

| | | |
|---|---|---|
| FR | 2754805 | 4/1998 |
| FR | 2929125 | 10/2009 |
| GB | 2010372 | 6/1979 |
| JP | S5245998 | 3/1977 |
| JP | S5280363 | 6/1977 |
| JP | S63123580 | 8/1988 |
| SU | 992386 | 2/1983 |
| WO | 2013150383 | 10/2013 |

* cited by examiner

LIFTING ASSEMBLY

RELATED APPLICATIONS

This application is a continuation of U.S. patent application Ser. No. 13/959,831, filed Aug. 6, 2013, which is a continuation of U.S. patent application Ser. No. 13/440,011, filed Apr. 5, 2012, the contents of each of which is incorporated herein by reference in its entirety.

BACKGROUND

The present invention relates to cranes, hoists, and other overhead lifting devices. More specifically, the invention relates to a lifting assembly that is selectively engaged with a load to be lifted.

Lifting equipment often includes a rigid hook for engaging and suspending a strap, chain, or trunnion that is coupled to the load. Depending, in part, on its load rating, the hook can be large, heavy, and difficult for an operator to manually manipulate. Where access is limited, and especially where hazardous or nuclear materials are present, the acts of hooking and unhooking the load can be difficult and dangerous.

SUMMARY

In one embodiment, the invention provides a lifting assembly. The lifting assembly includes a link member suspended from a base along a vertical axis. The lifting assembly also includes a jaw member pivotally coupled to the link member about a pivot axis, the jaw member defining a cam portion having a cam surface such that engaging the cam surface with a load by lowering the lifting apparatus rotates a portion of the jaw member into alignment with a latch axis, whereby a latch pin may be received by the jaw member and the link member. The jaw member further includes a hooking portion and a suspension portion disposed between the hooking portion and the cam portion. The hooking portion includes a receiving surface that guides the jaw member into engagement with the load when hooking the load. When the jaw member is in an open, unlatched position, the receiving surface has a downward slope extending from the hooking portion toward the suspension portion relative to an axis that is perpendicular to the vertical axis.

In another embodiment, the invention provides a method of selectively engaging a load to a lifting apparatus having a link member suspended along a vertical axis and a jaw member pivotally coupled to the link member. The method includes rotating the jaw member about a pivot axis, thereby exposing a hooking portion of the jaw member. The method further includes hooking the load with the hooking portion, lowering the lifting apparatus while engaging a cam surface of the jaw member upon the load, thereby rotating the jaw member into alignment with a latch axis of the link member, and latching the jaw member to the link member. The jaw member includes a cam portion and a suspension portion disposed between the hooking portion and the cam portion, the cam portion defining the cam surface. The step of hooking includes guiding the jaw member into engagement with the load with a receiving surface on the hooking portion. When the jaw member is in an open, unlatched position, the receiving surface has a downward slope extending from the hooking portion toward the suspension portion relative to an axis that is perpendicular to the vertical axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
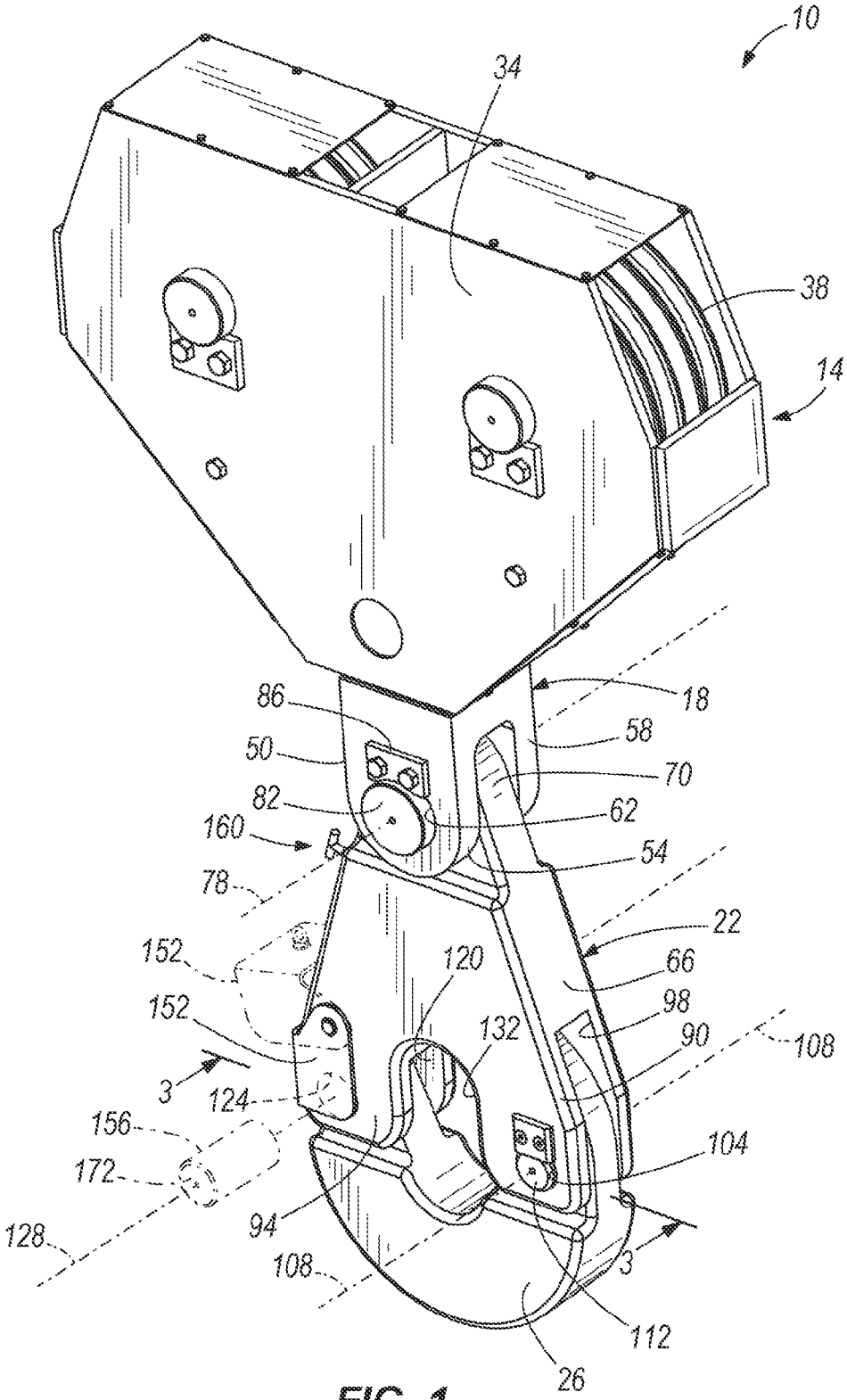
FIG. 1 is a perspective view of a lifting assembly.

Referring to FIG. 1, a lifting assembly 10 includes an upper assembly 14, a swivel 18, a link assembly 22, and a jaw member 26. The lifting assembly 10 is configured to engage a load for lifting and movement. More specifically, the lifting assembly 10 is configured to engage a trunnion 30 (FIGS. 3-5) of a load. The trunnion 30 may be coupled, for example, to a nuclear fuel assembly, a nuclear fuel cask, or other load.

Referring to FIG. 1, the upper assembly 10 includes a body 34 that rotatably supports an arrangement of pulleys 38. The pulleys 38 facilitate raising and lowering the lifting assembly 10, including an attached load, when used in conjunction with a wire rope (i.e. a metallic cable) and a hoist motor (not shown).

The swivel 18 is rotatably coupled to the body 34. The swivel 18 includes a connecting portion 50 for pivotally supporting the link assembly 22. More specifically, the connecting portion 50 includes a first support extension 54 and a second support extension 58. The first support extension 54 and the second support extension 58 each define a swivel aperture 62.

Figure 3:
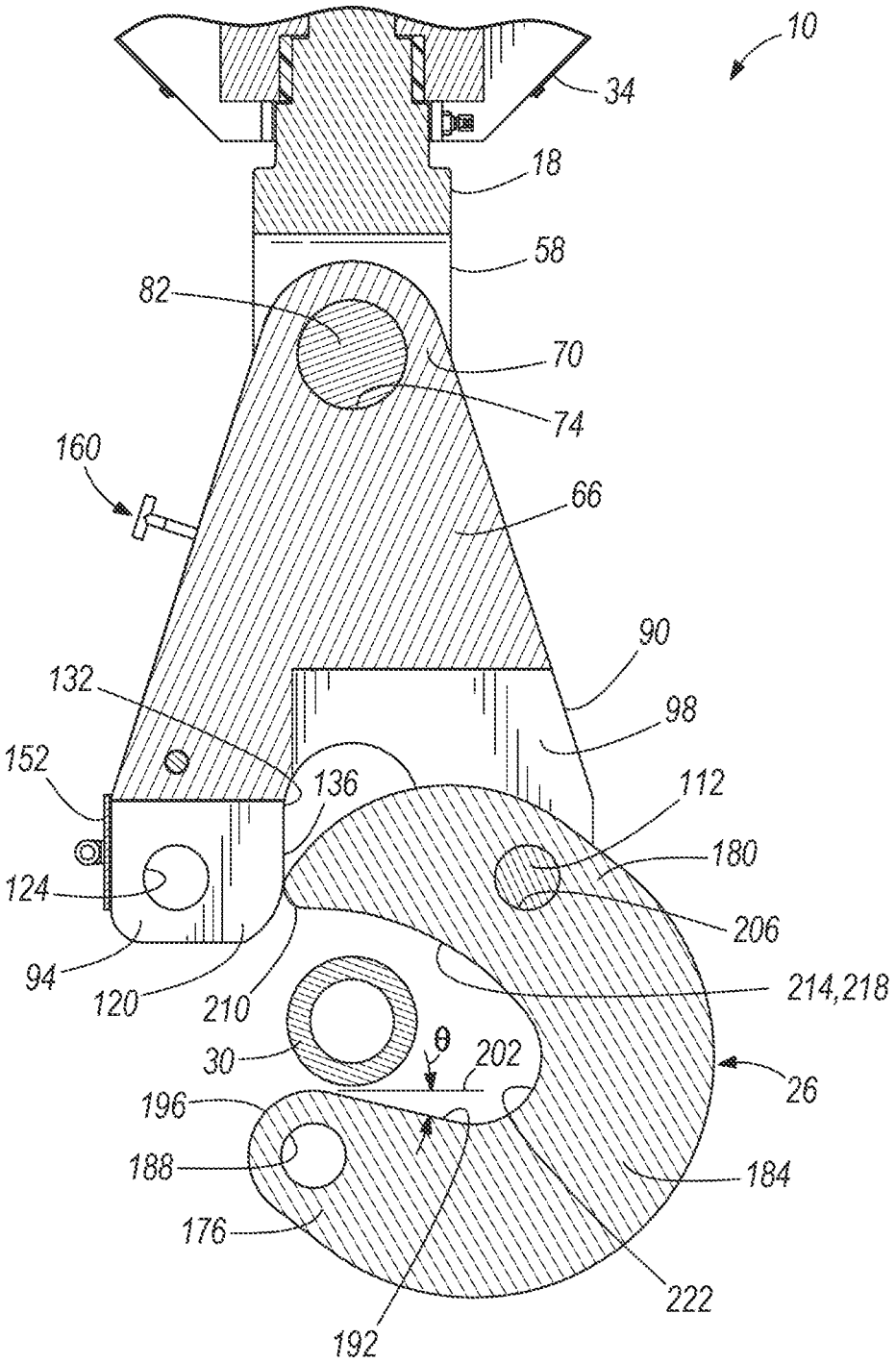
FIG. 3 is a cross sectional view of a portion of the lifting assembly of FIG. 1, with a jaw member hooking a trunnion of a load.
Figure 4:
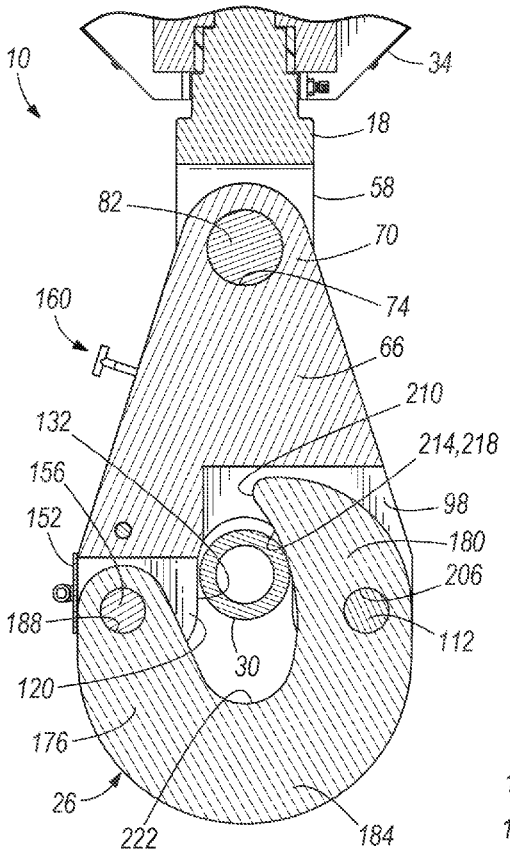
FIG. 4 is a cross sectional view of a portion of the lifting assembly of FIG. 1, with a cam surface of the jaw member engaging the trunnion.
Figure 5:
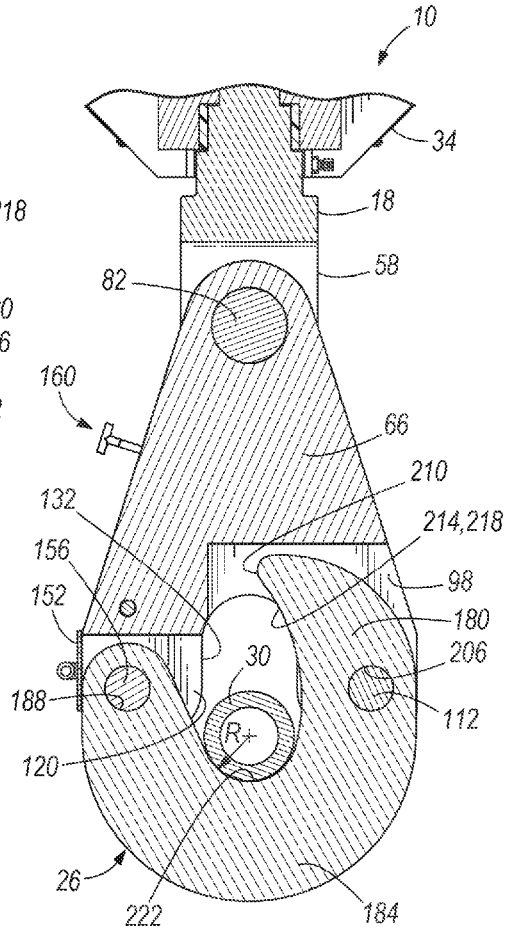
FIG. 5 is a cross sectional view of a portion of the lifting assembly of FIG. 1, with the trunnion suspended from the jaw member.

The link assembly 22 includes a link body 66. The link body 66 includes a support portion 70 for pivotal engagement with the support extensions 54 and 58 of the swivel 18. The support portion 70 defines a link support aperture 74 (FIGS. 3-5). With the support portion disposed between the first support extension 54 and the second support extension 58, the link support aperture 74 is aligned with the swivel apertures 62 along a link pivot axis 78 (FIG. 1). A link pivot pin 82 is inserted through the swivel apertures 62 and the link support aperture 74 to pivotally couple the link assembly 22 to the swivel 18. A link pivot retainer plate 86 is fixedly coupled to the connecting portion 50 to inhibit the link pivot pin 82 from movement.

The link body 66 further includes a first leg portion 90 and a second leg portion 94. The first leg portion 90 defines a first jaw cutout 98 for receiving a portion of the jaw member 26. The first leg portion 90 further defines a link pivot aperture 104 oriented along a jaw pivot axis 108. The jaw pivot axis 108 is substantially parallel to the link pivot axis 78. A jaw pivot pin 112 is disposed within the jaw pivot aperture 108. A jaw pivot retainer plate 116 is fixedly coupled to the link body 66 to inhibit the jaw pivot pin 112 from movement.

The second leg portion 94 defines a second jaw cutout 120 for receiving a portion of the jaw member 26. The second leg portion 94 further defines a link latch aperture 124 oriented along a jaw latch axis 128. The jaw latch axis 128 is substantially parallel to the link pivot axis 78 and jaw pivot axis 108.

Figure 2:
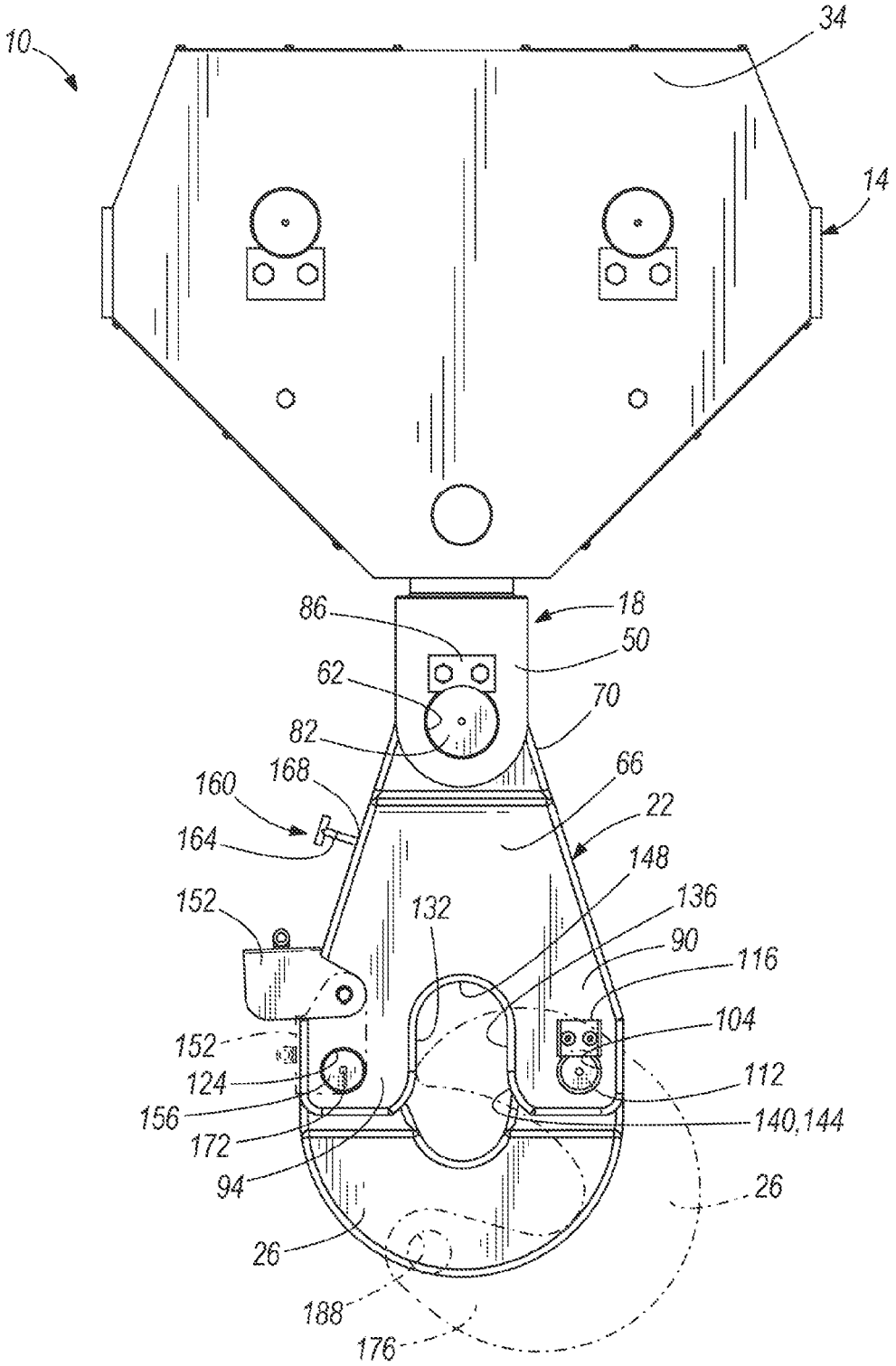
FIG. 2 is a side view of the lifting assembly of FIG. 1.

A trunnion recess 132 is defined in the link body 66, between the first leg portion 90 and the second leg portion 94. As illustrated in FIG. 4, the trunnion recess 132 is sized and configured to slidably receive the trunnion 30 during actuation of the jaw member 26. Referring to FIGS. 1 and 2, the trunnion recess 132 includes substantially parallel wall portions 136, an inlet portion 140 with fillets 144 for smooth engagement with the trunnion 30, and a radiused end portion 148.

Referring to FIGS. 1 and 2, the link assembly 22 further includes a latch pin cover 152. The latch pin cover 152 is pivotally coupled to the link body 66, more specifically, to the second arm portion 94. In a closed position (FIG. 1), the latch pin cover 152 extends across the second arm portion 94 to obstruct both ends of the link latch aperture 124. In an open position (FIG. 2), the latch pin cover 152 is rotated away from the second arm portion 94, thereby exposing the link latch aperture 124. With the link latch aperture 124 exposed, a jaw latch pin 156 may be selectively inserted or removed from the link latch aperture 124, along the jaw latch axis 128.

Referring to FIG. 2, a detachable pin handle 160 is provided with the lifting assembly 10. The pin handle 160 includes a T-shaped body 164 with an end portion 168. The end portion 168 may be selectively engaged with a corresponding aperture 172 of the jaw latch pin 156 to facilitate inserting and withdrawing the jaw latch pin 156 from the link latch aperture 124. In one construction, the pin aperture 172 includes a female threaded portion and the end portion 168 of the pin handle 160 includes a male threaded portion. When not in use, the pin handle 160 is detachably coupled to the link body 66.

With the jaw latch pin 156 removed, the jaw member 26 is rotatable between a closed position (FIGS. 1, 4 and 5) and an open position (FIG. 3 and broken line illustration of FIG. 2). Referring now to FIG. 3, the jaw member 26 includes a hooking portion 176, a cam portion 180, and a suspension portion 184 disposed between the hooking portion 176 and the cam portion 180.

The hooking portion 176 includes a jaw latch aperture 188. The jaw latch aperture 188 is sized to slidably receive the jaw latch pin 156. When the jaw member 26 is rotated to the closed position (FIGS. 1, 4 and 5), the jaw latch pin 156 may be inserted through the link latch aperture 124 and jaw latch aperture 188 along the jaw latch axis 128 (FIG. 1).

Referring to FIG. 3, the hooking portion 176 further defines a receiving surface 192. The receiving surface 192 is configured to guide the jaw member 26 into engagement with the trunnion 30 when hooking a load. The receiving surface 192 includes a rounded end portion 196 and extends to the suspension portion 184. With the jaw member 26 in the open position, the receiving surface 192 has a downward slope 8 relative to a horizontal axis 202.

The cam portion 180 includes a jaw pivot aperture 206. The jaw pivot aperture 206 is sized to slidably receive the jaw pivot pin 112, such that the jaw member 26 is pivotally coupled to the first leg portion 90 about the jaw pivot pin 112. The cam portion 206 also includes a cam tip 210 and a cam surface 214. As shown in FIG. 3, the cam tip 210 contacts the wall portion 136 of the trunnion recess 132 when the jaw member 26 is in an open position, thereby stabilizing the jaw member 26 to facilitate hooking and unloading of a load.

The cam surface 214 is disposed substantially opposite, and substantially facing, the receiving surface 192. The cam surface 214 has a curvature 218 between the suspension portion 184 and the cam tip 210. As shown in FIG. 3, when the jaw member 26 is in the open position, and the trunnion 30 is disposed between the receiving surface 192 and the cam surface 214, the trunnion 30 is substantially aligned with the trunnion recess 132 of the link body 66. When the lifting assembly 10 is lowered upon the trunnion 30, contact between the cam surface 214 and the trunnion 30 causes the jaw member 26 to rotate about jaw pivot axis 108.

Referring to FIG. 4, rotation of the jaw member 26 about the jaw pivot axis 108 continues as the lifting assembly 10 is lowered, until the jaw latch aperture 188 is substantially aligned with the link latch aperture 124. Once the jaw latch aperture 188 and link latch aperture 124 are aligned, a user can open the latch pin cover 152 (if not open already), insert the jaw latch pin 156, and close the jaw latch cover 152.

Referring to FIG. 5, with the jaw member 26 latched in the closed position, raising the lifting assembly 10 engages the trunnion 30 with the suspension portion 184 of the jaw member 26. The suspension portion 184 includes a suspension surface 222. The suspension surface 222 has a radius R corresponding to the trunnion 30, such that forces from the load are distributed on the suspension surface 222.

In order to unload the lifting assembly 10, the steps of FIGS. 3-5 are reversed. With the load safely positioned, the lifting assembly 10 is lowered upon the trunnion 30, as illustrated in FIG. 4. The latch pin cover 152 is opened and the jaw latch pin 156 is withdrawn, as illustrated in FIG. 1. With the latch pin 156 withdrawn, the jaw member 26 rotates to the open position, as shown in FIG. 3, and the jaw member 26 is unhooked from the trunnion 30.

Thus, the invention provides, among other things, a lifting assembly. Various features and advantages of the invention are set forth in the following claims.

What is claimed is:

1. A lifting apparatus comprising:

a link member suspended from a base along a vertical axis; and a jaw member pivotally coupled to the link member about a pivot axis, the jaw member defining a cam portion having a cam surface such that engaging the cam surface with a load by lowering the lifting apparatus rotates a portion of the jaw member into alignment with a latch axis, wherein the pivot axis and latch axis are disposed on opposing sides of the vertical axis, whereby a latch pin may be received by the jaw member and the link member, the jaw member further including a hooking portion and a suspension portion disposed between the hooking portion and the cam portion;

wherein the hooking portion includes a receiving surface that guides the jaw member into engagement with the load when hooking the load, and wherein when the jaw member is in an open, unlatched position, the receiving surface has a downward slope extending from the hooking portion toward the suspension portion relative to an axis that is perpendicular to the vertical axis.

2. The lifting apparatus of claim 1 wherein the pivot axis and latch axis are disposed on a plane that is substantially non-parallel to the vertical axis.

3. The lifting apparatus of claim 1 wherein the pivot axis and latch axis are disposed on a plane that is perpendicular to the vertical axis.

4. The lifting assembly of claim 1 wherein the link member includes a first leg portion defining the jaw pivot axis and a second leg portion defining the jaw latch axis, and wherein a recess is defined between the first leg portion and the second leg portion.

5. The lifting apparatus of claim 4, wherein the recess is substantially U-shaped.

6. The lifting apparatus of claim 1 wherein the base comprises a swivel.

7. The lifting apparatus of claim 6 wherein the link member is pivotally coupled to the swivel about a link pivot pin extending through the vertical axis.

8. The lifting apparatus of claim 1 wherein the pivot axis is substantially perpendicular to the vertical axis.

9. The lifting apparatus of claim 1 wherein the receiving surface substantially faces the cam surface.

10. The lifting apparatus of claim 9 wherein the suspension portion includes a suspension surface configured to receive a trunnion of the load.

11. The lifting apparatus of claim 1 and further comprising a latch pin, and wherein the hooking portion defines an aperture for receiving the latch pin.

12. The lifting apparatus of claim 1 and further comprising a pivot pin, and wherein the cam portion defines an aperture for receiving the pivot pin.

13. The lifting apparatus of claim 12, wherein the jaw member is pivotally coupled to the link member about the pivot pin.

14. The lifting apparatus of claim 1 wherein the jaw member is pivotable between a first position, wherein the jaw member is open to receive a trunnion of the load, and a second position, wherein the trunnion is substantially captured by the jaw member and the link member.

15. A method of selectively engaging a load to a lifting apparatus having a link member suspended along a vertical axis and a jaw member pivotally coupled to the link member, the method comprising:

rotating the jaw member about a pivot axis, thereby exposing a hooking portion of the jaw member;

hooking the load with the hooking portion;

lowering the lifting apparatus while engaging a cam surface of the jaw member upon the load, thereby rotating the jaw member into alignment with a latch axis of the link member, the pivot axis and the latch axis being disposed on opposing sides of the vertical axis; and latching the jaw member to the link member;

wherein the jaw member includes a cam portion and a suspension portion disposed between the hooking portion and the cam portion, the cam portion defining the cam surface, and wherein the step of hooking includes guiding the jaw member into engagement with the load with a receiving surface on the hooking portion, and wherein when the jaw member is in an open, unlatched position, the receiving surface has a downward slope extending from the hooking portion toward the suspension portion relative to an axis that is perpendicular to the vertical axis.

16. The method of claim 15 and further comprising raising the lifting apparatus along the vertical axis to lift the load.

17. The method of claim 15 and further comprising engaging a suspension portion of the jaw member with the load.

18. The method of claim 15 and further comprising:

supporting the load to provide slack between the jaw member and the load;

unlatching the link member from the jaw member;

raising the lifting apparatus, thereby allowing the jaw member to rotate about the pivot axis; and withdrawing the hook portion from the load.

19. The method of claim 15 and further comprising receiving the load in a recess of the link member.

20. The method of claim 19, wherein the link member includes a first leg portion defining the pivot axis and a second leg portion defining the latch axis, and wherein the recess is defined between the first leg portion and the second leg portion.

21. The method of claim 20, wherein the recess is substantially U-shaped.

22. A lifting apparatus comprising:

a link member suspended from a base along a vertical axis; and a jaw member pivotally coupled to the link member about a pivot axis, the jaw member defining a cam portion having a cam surface such that engaging the cam surface with a load by lowering the lifting apparatus rotates a portion of the jaw member into alignment with a latch axis, whereby a latch pin may be received by the jaw member and the link member, the jaw member further including a hooking portion and a suspension portion disposed between the hooking portion and the cam portion;

wherein the hooking portion includes a receiving surface that guides the jaw member into engagement with the load when hooking the load, and wherein when the jaw member is in an open, unlatched position, the receiving surface has a downward slope extending from the hooking portion toward the suspension portion relative to an axis that is perpendicular to the vertical axis; and wherein the link member includes a first leg portion defining the pivot axis and a second leg portion defining the latch axis, and wherein a recess is defined between the first leg portion and the second leg portion.

23. The lifting apparatus of claim 22, wherein the recess is substantially U-shaped.

* * * * *